United States Patent [19]

Savov et al.

[11] 4,246,023

[45] Jan. 20, 1981

[54] METHOD AND APPARATUS FOR THE REFINING OF IRON-BASED MELTS

[75] Inventors: Peter H. Savov; Vassil G. Peev; Alexander Y. Valchev; Nikola A. Lingorski, all of Sofia, Bulgaria

[73] Assignee: DSO "Charna Metalurgia", Sofia, Bulgaria

[21] Appl. No.: 59,582

[22] Filed: Jul. 23, 1979

Related U.S. Application Data

[63] Continuation-in-part of Ser. No. 920,273, Jun. 29, 1978.

[30] Foreign Application Priority Data

Jul. 1, 1977 [BG] Bulgaria ..... 36772

[51] Int. Cl.[2] ..... C21C 5/52; H05B 7/18

[52] U.S. Cl. ..... 75/12; 13/9 R

[58] Field of Search ..... 75/49, 59, 53, 12; 266/200; 13/9

[56] References Cited

U.S. PATENT DOCUMENTS

| | | | |
|---|---|---|---|
| 2,909,422 | 10/1959 | Schwabe | 75/12 |
| 3,203,883 | 8/1965 | Ototani | 75/12 |
| 3,501,290 | 3/1970 | Finkl | 75/12 |

*Primary Examiner*—P. D. Rosenberg

*Attorney, Agent, or Firm*—Karl F. Ross

[57] ABSTRACT

An apparatus and a method of operating an apparatus for the refining of a ferrous melt make use of a ladle with a removable cover provided with a porous plug at its bottom through which an inert gas is introduced. A direct current source is connected to an electrode means comprising at least three electrodes in electrical contact with the melt.

14 Claims, 4 Drawing Figures

METHOD AND APPARATUS FOR THE REFINING OF IRON-BASED MELTS

CROSS REFERENCE TO RELATED APPLICATIONS

This application is a continuation-in-part of copending Ser. No. 920,273 filed June 29, 1978 and claiming a Bulgarian priority date of July 1, 1977. All material in copending Ser. No. 920,273 is expressly incorporated herein by reference.

FIELD OF THE INVENTION

This invention relates to an apparatus for the refining of iron-based melts using DC heating and gas-stirring of the melt. This invention also relates to a method of operating the apparatus.

BACKGROUND OF THE INVENTION

There are known methods of out-of-furnace steel-refining, wherein the establishment of a vacuum in the ladle is used in combination with AC arc-heating (ASEA-SKF Finkle et al-processes) with simultaneous gas or electromagnetic stirring of the melt inside the ladle. Another version of induction heating has also been developed (IT-process). The basic shortcoming of these methods is the prolonged treatment cycle due to the interruptions between the degassification-processes employing vacuum conditions, the electric-arc heating and the desulfurization all conducted as independent steps.

Devices, using vacuum-type systems together with AC-arc or other types of heating of the metal melt inside the ladle use two or more sequentially located stands for the vacuum and heating systems, each stand having an appropriate device for the stirring of the melt.

The simultaneous and successive uses of vacuum and AC-arc heating is linked to a complicated design of the roof or the upper part of the vacuum chamber to rapid wear of the lining and to high consumption of electrodes.

OBJECT OF THE INVENTION

The object of the invention is to provide an apparatus for the refining of iron-base melts, wherein the degassification, the deoxidation, the alloying, the homogenization as per composition and temperature and the desulfurization are effected in a single production cycle.

Another object of the invention is to provide a method of operating such an apparatus.

SUMMARY OF THE INVENTION

These objects are obtained according to the invention by an apparatus for the electrochemical refining of an iron base melt in contact with a liquid slag comprising alumina and lime. The apparatus includes an upright ladle having a bottom provided with a discharge port. The ladle is provided with a cover which is removably mounted thereon and is provided with a means for sealing to connect the cover thereto. The apparatus further an electrode means with at least three electrodes in electrical contact with the liquid slag. The apparatus also includes a direct-current source having a first terminal connected to at least one of the electrodes making up the electrode means. The direct current source also comprises a second terminal connected to a remaining electrode included in the electrode means. The electrode means is then used to degassify and desulfurize the iron-base melt. The apparatus further comprises a porous plug in the bottom of the ladle and a means for introducing an inert gas into the iron base melt through the porous plug. Lastly the apparatus includes an opening in the cover of the ladle for venting a stream of the products of the electrochemical degassification and desulfurization of the iron base melt.

A preferred feature of the apparatus further includes a lance trained on the surface of the iron-base melt for directing oxygen thereagainst.

Another preferred feature of the invention is the use of a vacuum source connected to the opening in the cover of the ladle to facilitate the venting of the products of the electrochemical degassification of the iron base melt.

Another feature of the invention includes at least one of the electrodes comprising the electrode means provided with a passage for introducing a gas into the ladle reactor in contact with the iron-base melt.

There are several preferred features involving the electrode means comprising at least three electrodes. In one feature the electrode means comprises a first electrode mounted in the ladle and in direct contact with the liquid slag therein. The means also includes a second electrode received in the cover of the ladle and in direct contact with the liquid slag. A third electrode is also received in the cover and reaches therefrom toward the surface of the liquid slag in the ladle but terminates above the slag.

In another feature of the invention the electrode means comprises a first and a second electrode received in the cover and in direct contact with the liquid slag and a third electrode received in the cover and reaching therefrom toward the surface of the liquid slag but terminating thereabove.

In another feature of the invention the electrode means comprises a first and a second electrode each mounted in the ladle and in direct contact with the liquid slag therein and a third electrode received in the cover and reaching therefrom toward the surface of the liquid slag but terminating thereabove.

In another feature of the invention the electrode means comprises a first and a second electrode each received in said cover and reaching therefrom toward the surface of the liquid slag but terminating thereabove and a third electrode received in said cover and in direct contact with the liquid slag therein.

In yet another feature of the invention the electrode means comprises three electrodes each of which is individually either mounted in the ladle or received in the cover or each of them is individually in direct contact with the liquid slag therein.

It should be pointed out that all of the electrodes comprising the electrode means are in electrical contact with the liquid slag. The electrodes may also be in electrical contact with the iron-base melt. In some cases the electrodes are in direct physical contact with the liquid slag and in some cases with both the liquid slag and the iron base melt. In other cases the electrodes reach toward the surface of the liquid slag but terminate thereabove. There is no direct contact between the electrode and the liquid slag here. However, there is electrical contact present in the form of arcing.

In summary the apparatus includes a reactor ladle with holes in its bottom which receive porous refractory plugs for the blowing of the iron-base melt in the reactor and a hole for the pouring cap. The ladle is covered by a movable roof with a sand-or other type of seal for the furnace space. Through the cover which may be fireproof, one or more graphite electrodes may be inserted (i.e. one or more anodes and a cathode). It is also possible to electrically contact the electrodes with the metal melt by mounting the electrodes in the body of the ladle.

The apparatus makes it possible to carry out a flexible run on a broad scale of technical operations such as deoxidation, degassification, desulfurization, alloying and nitrogenization.

The objects are also attained according to the invention by the method of operating the new apparatus as a furnace for the refining of iron-base melts. According to the new method the iron base melt containing deleterious gases and undesired admixtures are fed into the ladle reactor. Then materials containing CaO, $Al_2O_3$, Ca and $O_2$ are added for forming a layer of liquid slag on the surface of the metal melt. Then the cover is applied and sealed to the ladle reactor. Next and inert atmosphere is created over the liquid slag by adding an inert gas to the ladle reactor through a porous plug in the base. Then the direct current source is activated to heat the iron base melt and the liquid slag as well as to effect an electrochemical reaction because the power source is connected to the electrode means comprising at least three electrodes in electrical contact with the liquid slag. As a result deleterious gases and undesired admixtures are electrochemically removed from the iron base melt.

A preferred feature of the new method involves evacuating the electrochemical oxidation-reduction products of the deleterious gases and undesired admixtures from the ladle reactor above the liquid slag through an opening in the cover.

Another feature of the invention involves the introduction of oxygen to the ladle reactor into the iron melt by adding the oxygen through the cover.

In another feature of the claimed invention, the composition of the liquid slag layer covering the iron base melt contains not less than 15% alumina with a base index expressed by the relation $CaO/SiO_2$ higher than 1.8.

In another feature of the invention the deleterious gases are sulfur-containing gases. In yet another feature of the invention the oxygen-sulfur-containing gases are either sulfur, hydrogen sulfide or mixtures thereof.

The preferred configurations for the electrode means comprising at least three electrodes in electrical contact with the liquid slag are the same configurations as those indicated hereinabove in the discussion of the apparatus.

In accordance with the method the degassing and the desulfurizing are achieved by electrochemical reactions, which take place when using DC heating, thus providing for a prevention of the losses of heat during the treatment and a fast melting and heating of the materials forming the slag layer convering the metal bath.

The mechanism of these reactions is as follows in the case of the use of carbon (graphite) electrodes:

(1) in the slag, heated up to high temperature:

$2CaO.SiO_2 \rightleftarrows 2Ca^{2+} + SiO_4^{4-}$ $CaF_2 \rightleftarrows Ca^{2+} + 2F^-$ (2) reactions at the cathode:

$2Ca^{2+} + 4e^- \rightarrow 2Ca$ $Ca + [O] \rightarrow CaO$ $Ca + [S] \rightarrow CaS$ $2H^+ + 2e^- \rightarrow \{H_2\}$ (3) reactions at the anode or the anodes:

$SiO_4^4 - \rightarrow SiO_4 + 4e^-$ $SiO_4 \rightarrow SiO_2 + 2$ $4OH^- \rightarrow 2H_2O + 2 + 4e$ $40 + 4C$ from the electrode $\rightarrow \{CO\}$ $S^{2-} + 2 = \{SO_2) + 2e^-$

BRIEF DESCRIPTION OF THE DRAWING

We shall describe various embodiments of our invention in connection with the accompanying drawing in which.

SPECIFIC DESCRIPTION

Figure 1:
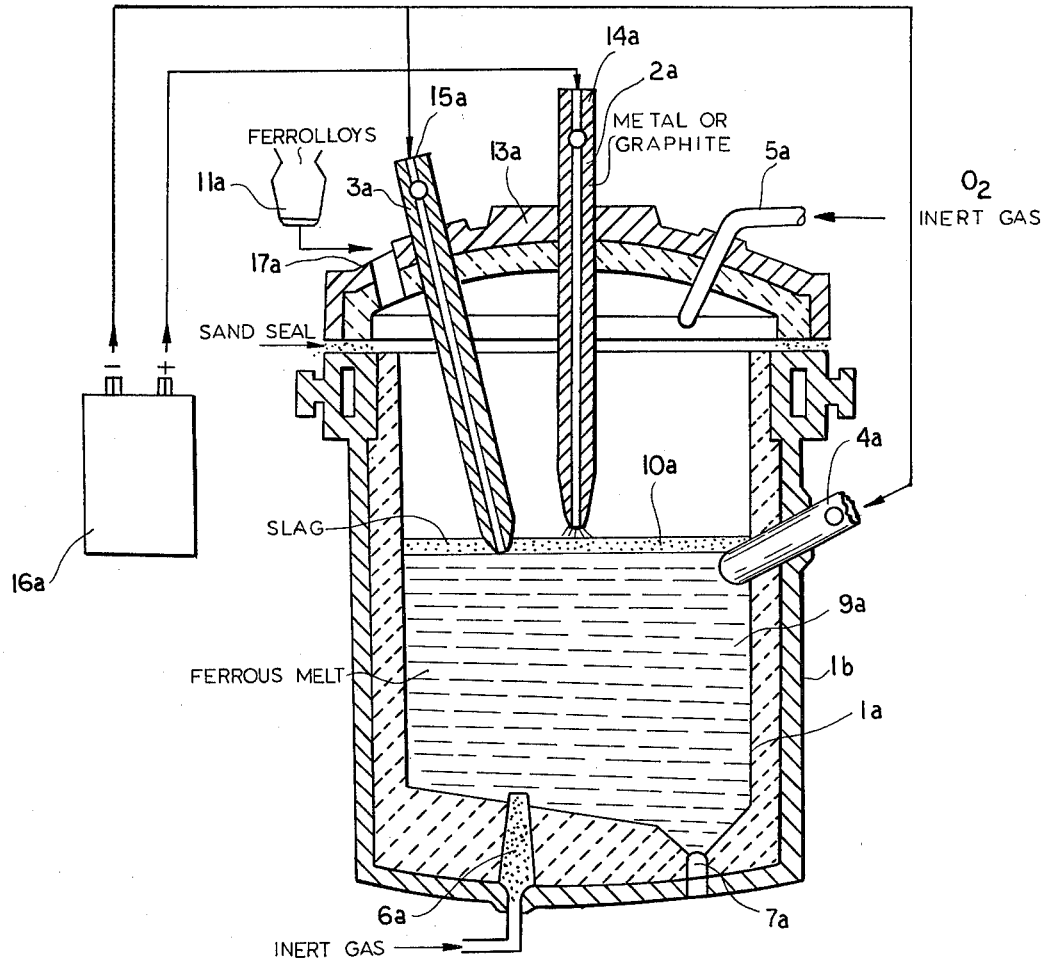
FIG. 1 is a cross-sectional view of an embodiment of the apparatus of the invention.

According to FIG. 1, after the charging of the metal-carrying ladle 1*a* within hood 1*b* under the roof 13*a*, inert gas is introduced via the tube 5*a* in order to obtain an inert atmosphere in the free space above the upper surface of metal 9*a* or the slag 10*a* and below the roof 13*a*. Alternatively any necessary dilution is effected by means of appropriate vacuum pumps.

Two or three minutes later the electric arc is ignited which burns between the cathode 2*a* and the metal 9 or the slag 10*a*. The power of the arc is automatically controlled but in such a way as to ensure the necessary density of the current for the electrochemical reactions and the necessary heat flow for the heating of the metal to the desired temperature and compensation of temperature losses coming from the blowing of the metal with argon or nitrogen. The quantity of the inert gas supplied through the porous plug 6*a* varies from 0.05 to 0.6 $mm^3/t$ during the blowing while the treatment time and the quantity of the blowing gas depend upon the composition of the melt and the required final concentration of the gases in the melt.

During the treatment through the hopper 11*a* by entrainment in the inert gas tube 5*a*, desulfurizing, deoxidizing and alloying mixtures are supplied to the process. By regulating the distance between the electrodes and the bath, it is possible to change the polarity of the liquid bath, to obtain a defined electrochemical reaction. Ten or fifteen minutes before the end of the metal treatment, the hopper 11*a* feeds ferroalloys into the melt for the correction of its composition; the melt temperature is noted and after the specification of the correcting composition, the metal treating operation may be regarded as complete.

For the production of stainless steel, highly alloyed with chromium, it is possible to blow with an oxygen-argon mixture through the porous plug 6*a* with an oxygen stream via a lance instead of inert gas via a tube 5*a* (i.e. in parallel with the blowing of inert gas through the bottom of the ladle).

The necessary heat flow is controlled as to power and time by highly precise automatic means, according to controlling programs preset for each melt, with the introduction of dynamic corrections after determining temperature and taking samples of the melt to analyze the process.

When the metal of the melt is to be alloyed with nitrogen or some other fluid, through the passages 14*a* and 15*a* of cathode 2*a*, or the anode 3*a*, the necessary quantity of alloying fluid is supplied. The device comprises the ladle 1*a* for the treatment and casting of the metal, the bottom of said ladle comprising, besides the metal pouring hole 7*a*, also the porous plug 6*a* to allow blowing with inert gas. The water-cooled anode 4*a* is laterally (angularly or radially) located, said anode being used for the introduction of the positive pole into the metal melt. Anodes 3*a* and 4*a* are in direct contact with the liquid slag. Cathode 2*a* reaches toward the surface of the liquid slag but terminates thereabove. Cathode 2*a* and anode 3*a* are received in cover 13*a*. Anode 4*a* is mounted in ladle 1*a*. The reactor ladle is covered by the refractory roof 13*a*, sealed to said ladle by means of a conventional seal, ensuring the necessary sealing of and for the operating space or room. Along the axis of the roof a hole is provided through which passes the graphite or metal cathode 2*a*. Laterally to this cathode, that is angularly or parallel, one or more holes receiving the metal or graphite anodes are provided. At a distance less than ½ of the radius, there is a hole for the supply of inert gas, or a flange-type fitting for connection to the vacuum system. At one end of the roof the hole 17*a* is provided for the supply of ferroalloys from the hopper 11. In operation the positive pole of the current is introduced through the anodes 3*a* or 4*a*. When necessary to alloy the metal melt with gas, the gases are fed through the passages 14*a* or 15*a* of the cathode 2*a* and the anode 3*a*, electrically supplied by the DC source 16*a*.

According to FIG. 2, after the charging of the metal-carrying ladle 5 within a ladle hood 4 under the roof 2, inert gas is introduced via the tube 9 in order to obtain an inert atmosphere in the free space above the upper surface of metal 9*a* or the slag 10*a* and below the roof 2. Alternatively any necessary dilution is effected by means of appropriate vacuum pumps.

Two or three minutes later the electric arc is ignited which burns between the cathode 7 and the metal 9*a* or the slag 10*a*. The power of the arc is automatically controlled but in such a way as to ensure the necessary density of the current for the run of the electrochemical reactions and the necessary heat flow for the heating of the metal to the desired temperature and compensation of temperature losses coming from the blowing of the metal with argon or nitrogen. The quantity of the inert gas supplied through the porous plug 8 varies from 0.05 to 0.6 $mm^3/t$ during the blowing while the treatment time and the quantity of the blowing gas depend upon the composition of the melt and the required final concentration of the gases in the melt.

During the treatment through the hopper 1, desulfurizing, deoxidizing and alloying mixtures are supplied to the process through passage 1'. By regulating the distance between the electrodes and the bath, it is possible to change the polarity of the liquid bath to obtain a defined electrochemical reaction. Ten or fifteen minutes before the end of the metal treatment, the hopper 1 feeds ferroalloys into the melt for the correction of its composition; the melt temperature is noted and after the specification of the correcting composition, the metal treating operation may be regarded as complete.

For the production of stainless steel, highly alloyed with chromium it is possible to blow with an oxygen-argon mixture through the porous plug 8 or with an oxygen stream via a lance instead of inert gas via tube 9 (i.e. in parallel with the blowing-in of inert gas through the bottom of the ladle).

The necessary heat flow is controlled as to power and time by highly precise automatic means, according to controlling programs preset for each melt, with the introduction of dynamic corrections after determining temperature and taking samples of the melt to analyze the process.

Figure 2:
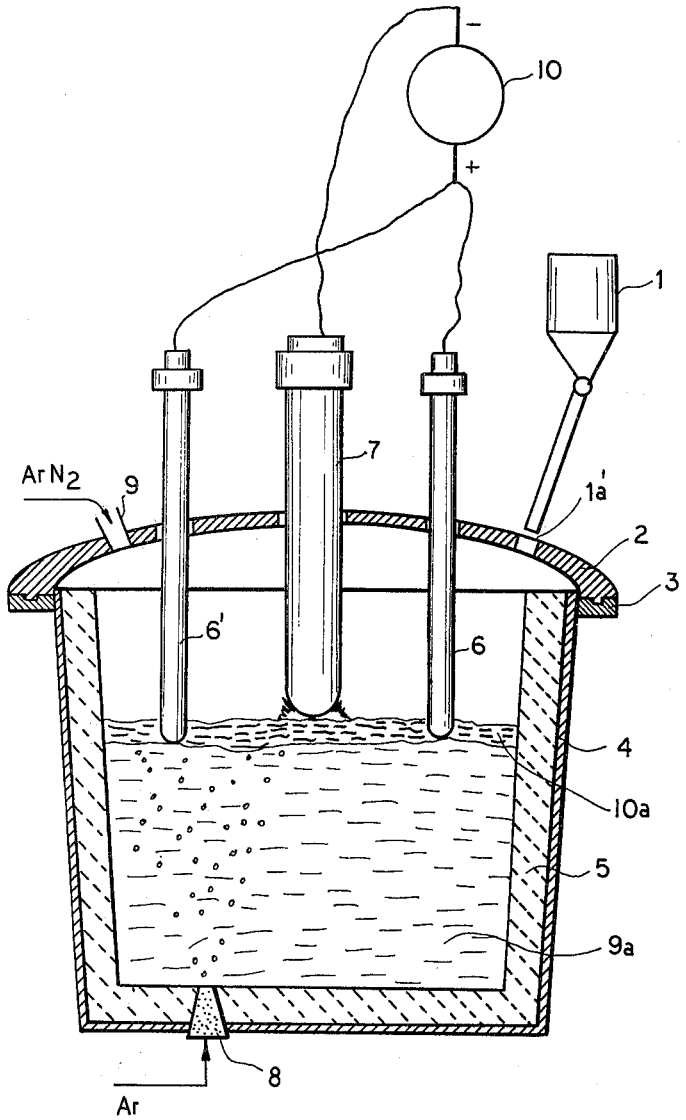
FIG. 2 is a cross-sectional view of another embodiment of the invention.

In FIG. 2 anodes 6 and 6' are received in the lined cover 2. Lined cover 2 may be sealed to ladle 5 by means of sealing flange 3. Anodes 6 and 6' received in lined cover 2 are in direct contact with liquid slag 10*a*. Cathode 7 is also received in the lined cover 2 and extends downward in ladle 5 toward the surface of the liquid slag 10*a* but terminates thereabove. Anodes 6 and 6' are connected to the positive pole of DC power source 10 and cathode 7 is connected to the negative pole of the DC power source.

According to FIG. 3 after the discharging of the metal-carrying ladle 15 within a ladle hood 14 under the roof 12, inert gas is introduced via the tube 19 in order to obtain an inert atmosphere in the free space above the upper surface of metal 9*a* or the slag 10*a* and below the roof 12. Alternatively any necessary dilution is effected by means of appropriate vacuum pumps.

Two or three minutes later the electric arc is ignited which burns between the cathode 17 and the metal 9*a* or the slag 10*a*. The power of the arc is automatically controlled but in such a way as to ensure the necessary density of the current for the run of the electrochemical reactions and the necessary heat flow for the heating of the metal to the desired temperature and compensation of temperature losses coming from the blowing of the metal with argon or nitrogen. The quantity of the inert gas supplied through the porous plug 18 varies from 0.05 to 0.6 $mm^3/t$ during the blowing while the treatment time and the quantity of the blowing gas depend upon the composition of the melt and the required final concentration of the gases in the melt.

During the treatment through the hopper 11, desulfurizing, deoxidizing and alloying mixtures are supplied to the process through passage 11'. By regulating the distance between the electrodes and the bath, it is possible to change the polarity of the liquid bath to obtain a defined electrochemical reaction. Ten or fifteen minutes before the end of the metal treatment, the hopper 11 feeds ferroalloys into the melt for the correction of its composition; the melt temperature is noted and after the specification of the correcting composition, the metal treating operation may be regarded as complete.

For the production of stainless steel, highly alloyed with chromium, it is possible to blow with an oxygen-argon mixture through the porous plug 18 or with an oxygen stream via a lance instead of inert gas via a tube 19 (i.e. in parallel with the blowing-in of inert gas through the bottom of the ladle).

The necessary heat flow is controlled as to power and time by highly precise automatic means, according to controlling programs preset for each melt, with the introduction of dynamic corrections after determining temperature and taking samples of the melt to analyze the process.

Figure 3:
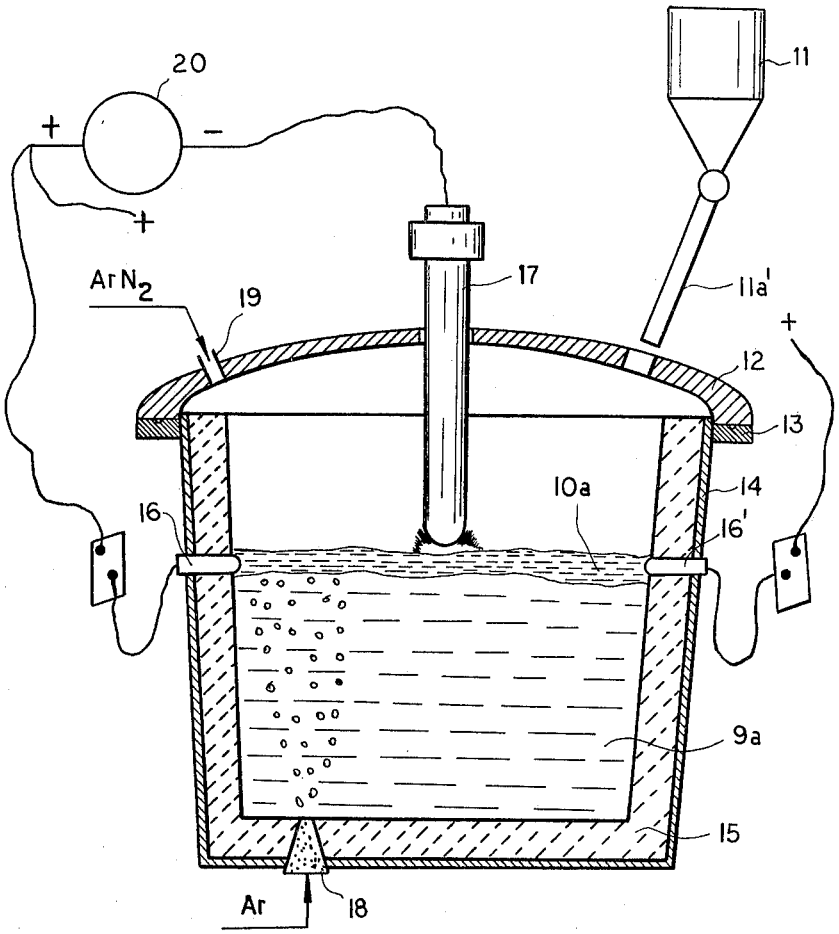
FIG. 3 is a cross-sectional view of another embodiment of the invention.

In FIG. 3 anodes 16 and 16' are mounted on ladle 15. Lined cover 12 may be sealed to ladle 15 by means of sealing flange 13. Anodes 16 and 16' mounted in ladle 15 are in direct contact with liquid slag 10*a*. Cathode 17 is received in the lined cover 12*a* and extends downward in ladle 15 toward the surface of the liquid slag 10*a* but terminates thereabove. Anodes 16 and 16' are connected to the positive pole of DC power source 20 and cathode 17 is connected to the negative pole of the DC power source.

According to FIG. 4, after the charging of the metal-carrying ladle 25 within a ladle hood 24 under the roof 22, inert gas is introduced via the tube 29 in order to obtain an inert atmosphere in the free space above the upper surface of metal 9*a* or the slag 10*a* and below the roof. Alternatively any necessary dilution is effected by means of appropriate vacuum pumps.

Two or three minutes later the electric arc is ignited which burns between the cathode 27 and the metal 9*a* or the slag 10*a*. The power of the arc is automatically controlled but in such a way as to ensure the necessary density of the current for the run of the electrochemical reactions and the necessary heat flow for the heating of the metal to the desired temperature and compensation of temperature losses coming from the blowing of the metal with argon or nitrogen. The quantity of the inert gas supplied through the porous plug 28 varies from 0.05 to 0.6 $mm^3/t$ during the blowing while the treatment time and the quantity of the blowing gas depend upon the composition of the melt and the required final concentration of the gases in the melt.

During the treatment through the hopper 21, desulfurizing, deoxidizing and alloying mixtures are supplied to the process through passage 21'. By regulating the distance between the electrodes and the bath, it is possible to change the polarity of the liquid bath to obtain a defined electrochemical reaction. Ten or fifteen minutes before the end of the metal treatment, the hopper 11 feeds ferroalloys into the melt for the correction of its composition; the melt temperature is noted and after the specification of the correcting composition the metal treating may be regarded as complete.

For the production of stainless steel, highly alloyed with chromium, it is possible to blow with an oxygen-argon mixture the porous plug 28 or with an oxygen stream via a lance instead of inert gas via a tube 29 (i.e. in parallel with the blowing-in of inert gas through the bottom of the ladle).

The necessary heat flow is controlled as to power and time by the highly precise automatic means, according to controlling programs preset for each melt, with the introduction of dynamic corrections after determining temperature and taking samples of the melt to analyze the process.

Figure 4:
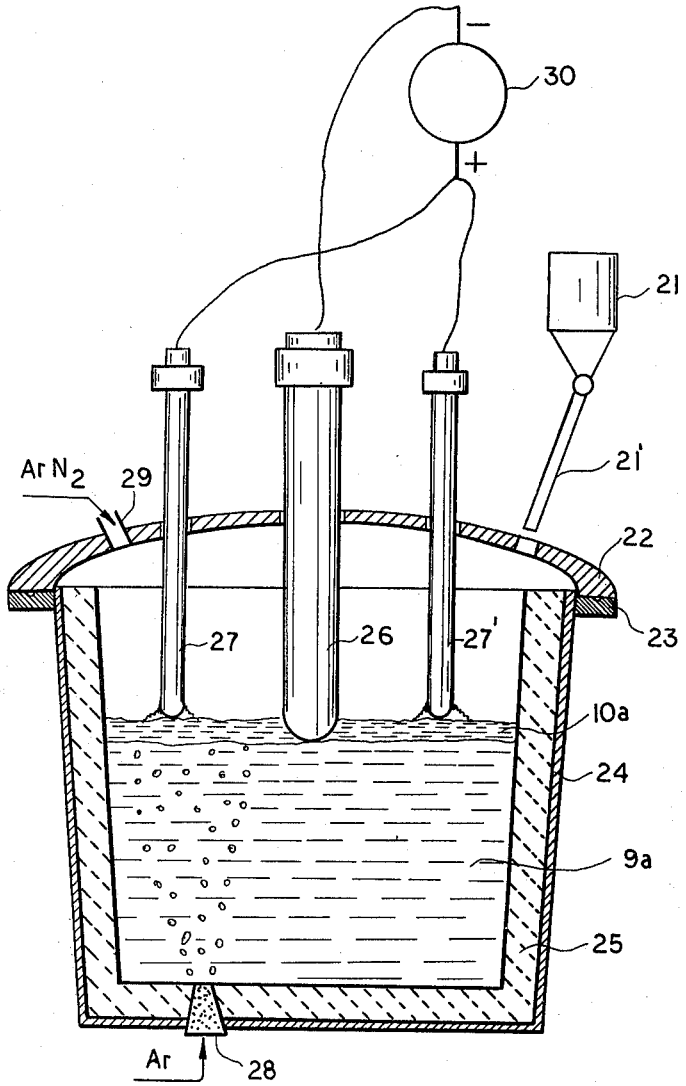
FIG. 4 is a cross-sectional view of yet another embodiment of the invention.

In FIG. 4 anodes 27 and 27' are received in the lined cover 22. Lined cover 22 may be sealed to ladle 25 by means of sealing flange 23. Anodes 27 and 27' received in lined cover 22 extend downward in ladle 5 toward the surface of the liquid slag 10*a* but terminate thereabove. Cathode 27 is also received in the lined cover 22 and extends downward in ladle 25 in direct contact with liquid slag 10*a*. Anodes 26 and 26' are connected to the positive pole of the DC power source 30 and cathode 27 is connected to the negative pole of the DC power source.

The following nonlimiting examples further illustrate the invention.

EXAMPLE 1

In the reaction ladle with a capacity of 500 kg there is poured 520 kg steel of the following chemical composition: (C)—0.55%; (Mn)—0.98%; (Si)—0.30%; (Cr)—1.30%; (S)—0.016%; (H)—5.8 ppm. By means of a crane and trolley, the ladle is brought underneath a movable roof; the latter is lowered until it fits tightly to the sand lock of the ladle. Over the surface of the metal level there are added 6 kg lime and 3 kg $Al_2O_3$. Both anodes of 50 mm diameter are lowered until they enter into the slag, then the cathode is lowered and after the switching-on of the direct-current source, the arc is ignited at the cathode. The temperature of the metal before the treatment is 1520° C. With the ignition of the arc, there is introduced through a porous plug in the bottom of the ladle continuously Ar in the quantity of 1.1 $Nm^3$/hour, and through a hole of 6 mm diameter in the cathode there are introduced 4.5 $Nm^3$/hour Ar. Twenty minutes after the beginning of the refining treatment in the apparatus there are added 1.0 kg lime, 120 g Al, 300 g Si-Ca, 200 g $CaC_2$. The DC parameters are as follows: current 1500 A, voltage 93 V. After treatment for a period of 60 minutes the compositions of the metal and the slag are as follows:

for the metal: (C)—0.61%; (Mn)—0.99%; (Si)—0.33%; (Cr)—1.31%; (S)—0.003%; (H)—2.2 ppm; temperature 1580° C.

for the slag: CaO—50.6%; FeO—1.10%; MnO—0.17%; Mg—3.20% $SiO_2$—6.0%; $Al_2O_3$—33.9%.

EXAMPLE 2

550 kg liquid steel of the following chemical composition are subjected to a treatment in accordance with the method of the invention: (C)—0.641%l(Mn)—1.10%; (Si)—0.17%; (P)—0.036%; (S)—0.0219%; $(Al)_{met}$—0.120%; (O)—105 ppm; (N)—31 ppm; (H)—4.67%; temperature 1540° C.

Duration of the treatment: 52 min

Duration of DC arc operation: 45 min comprising:

arc between cathode and slag: 35 min arc between anodes and slag: 10 min current 1700–2000 A at a voltage 87 V consumption of Ar for agitation: 0.9 $Nm^3$/hour consumption of Ar introduced through a hole in the roof: 4.0–6.0 $Nm^3$/hour As a result of the treatment, a steel of the following chemical composition is produced: (C)—0.654%; (Mn)—1.24%; (Si)—0.20%; (P)—0.036%; (S)—0.089%; $(Al)_{met}$—0.166%; (O)—16 ppm; (N)—28 ppm; (H)—2.52 ppm; temperature 1590° C.

The slag used during the treatment is of the following chemical composition: C aO—46.5%; MnO—1.20%; FeO—1.50%; $SiO_2$—3.7%; $Al_2O_3$—30.7%; MgO—15.2%.

The quantity of non-metallic inclusions before the treatment is 0.36% in accordance with JIS-G 0555, and after the treatment 0.17%.

EXAMPLE 3

530 kg of steel of the following chemical composition are subjected to a treatment in accordance with the method of our invention: (C)—0.670%; (Mn)—0.51%; (Si)—0.30%; (S)—0.006%; (O)—0.0079%; (N)—62 ppm; (H)—4.86 ppm; temperature 1500° C.

Duration of the treatment: 58 min duration of heating: 52 min comprising:

DC arc between cathode and slag: 42 min

DC arc between anodes and slag: 10 min current 1200–2400 A; voltage: 63 V consumption of Ar for agitation: 0.8 $m^3$/hour consumption of $N_2$ injected through the electrode: 4.5 $m^3$/hour.

As a result of the treatment, a steel of the following chemical composition is produced: (C)—0.654%; (Mn)—0.53%; (Si)—0.35%; (P)—0.032%; (S)—0.0026%; (O)—18 ppm; (N)—265 ppm; (H)—3.9 ppm; temperature 1550° C.

The slag used during the treatment is of the following chemical composition: CaO—40.4%; MnO—0.22%; FeO—0.45%; MgO—5.1%; $SiO_2$—10.8%; $Al_2O_3$—25.3%; $CaF_2$—10.5%.

EXAMPLE 4

570 kg of bearing steel of the following chemical composition are subjected to a treatment in accordance with the method of our invention: (C)—0.97%; (Mn)—0.20%; (Si)—0.25%; (S)—0.018%; (P)—0.016%; (Cr)—0.98%; (Ni)—0.10%; (O)—78 ppm; (H)—6.82 ppm; temperature 1500° C.

Duration of treatment: 64 min duration of production: 54 min (DC arc of small length between slag and cathode)

current 800–2000 A; voltage: 93 V consumption of Ar for agitation: 1.1 $m^3$/hour consumption of Ar blown through the roof: 3.0 $m^3$/hour As a result of the treatment, a steel of the following chemical composition is produced: (C)—0.01%; (Mn)—0.20%; (Si)—0.26%; (S)—0.008%; (P)—0.023%; (Cr)—1.01%; (Ni)—0.11%; (O)—24 ppm; (H)—1.8 ppm; temperature 1570° C.

The slag used during the treatment is of the following chemical composition: CaO—40.5%; MnO—0.26%; FeO—1.9%; MgO—8.3%; $CaF_2$—10%; $Al_2O_3$—21.3%.

We claim:

1. A method of operating a ladle reactor for the refining of an iron-base melt which comprises the steps of:

(a) introducing the iron-base melt into an upwardly open, closed-bottom ladle reactor to form a bath of the melt therein overlain by a layer of slag;

(b) covering and sealing said reactor with a cover removably placed thereon, said layer of slag containing calcium, aluminum and silicon;

(c) injecting an inert gas into said bath through a porous plug at the bottom of said reactor, thereby forming an inert atmosphere over the layer of slag and evacuating products emitted from the bath through an opening in the cover during the refining of the bath;

(d) disposing three spaced apart electrodes in electrical conducting relationship with the bath and said layer, including at least one electrode mounted in said cover, and connecting the positive terminal of a direct current source to at least one of the electrodes and the negative terminal of said direct current source to another of said electrodes, with all of said electrodes being connected to a terminal of said source whereby said bath and slag are heated electrically by said source and said bath and said slag undergo electrochemical desulfurization and decarbonization electrolytically as part of the refining of said bath, at least one of said electrodes penetrating into said layer of slag and at least one other of said electrodes being spaced above said layer of slag for producing an arc between the latter electrode and said layer; and (e) introducing oxygen into said melt through said cover.

2. The method defined in claim 1 wherein the layer of slag contains not less than 15% alumina and has a base index $CaO\text{-}SiO_2$ greater than 1.8.

3. The method defined in claim 1 wherein said electrodes include a first electrode mounted in the ladle and in contact with the liquid slag therein, but not in contact with said bath, and a second electrode received in said cover and reaching therefrom toward the surface of the liquid slag but terminating thereabove.

4. The method defined in claim 1 wherein said electrode means comprises a first and a second electrode received in said cover and contacting said layer of slag and a third electrode received in said cover and reaching therefrom toward the surface of the liquid slag, but terminating thereabove.

5. The method defined in claim 1 wherein said electrode means comprises a first and a second electrode each mounted in said ladle and in contact with the liquid slag therein and a third electrode received in said cover and reaching therefrom toward the surface of the liquid slag but terminating thereabove.

6. The method defined in claim 1 wherein said electrode means comprises a first and second electrode each received in said cover and reaching therefrom toward the surface of the liquid slag but terminating thereabove and a third electrode received in said cover and in contact with the liquid slag therein.

7. An apparatus for the electrochemical refining of an iron-base melt in contact with a liquid slag which forms a layer above a bath of the melt, said apparatus comprising:

an upright, upwardly open ladle having a closed bottom;

a seal formed along an upper edge of said ladle;

a cover removably fitting over the upper end and engaging said seal;

electrode means including at least three electrodes in contact with said slag layer, said electrodes including at least one electrode spaced above said layer and mounted in said cover for forming an arc with said layer, and at least one other electrode extending into said layer but terminating out of contact with said bath;

a direct current source having a positive terminal connected to at least one of the electrodes of the electrode means and a negative terminal connected to at least one of the electrode means and electrically supplying all of the electrodes of the electrode means whereby the bath and said layer are heated by the direct current and electrochemical desulfurization and decarbonization of the bath is effected;

a porous plug in the bottom of said ladle provided with means for introducing an inert gas into said bath;

an opening formed in said cover and provided with means for venting refining products from the region above said layer; and means for introducing oxygen into said melt.

8. The apparatus defined in claim 7 wherein the last-mentioned means includes a lense trained on the surface of said melt for directing oxygen threagainst.

9. The apparatus defined in claim 7 wherein the means for venting the region above said layer is a vacuum source connected to said opening.

10. The apparatus defined in claim 7 wherein at least one of said electrodes is provided with a passage for introducing a gas into said melt.

11. The apparatus defined in claim 7 wherein said electrode means comprises a first electrode mounted in said ladle and in contact with the liquid slag therein, a second electrode received in said cover and contacting said liquid slag and a third electrode received in said cover and reaching therefrom toward the surface of the liquid slag but terminating thereabove.

12. The apparatus defined in claim 7 wherein said electrode means comprises a first and a second electrode received in said cover and contacting said liquid slag and a third electrode received in said cover and reaching therefrom toward the surface of the liquid slag but terminating thereabove.

13. The apparatus defined in claim 7 wherein said electrode means comprises a first and a second electrode each mounted in said ladle and in contact with the liquid slag therein and a third electrode received in said cover and reaching therefrom toward the surface of the liquid slag but terminating thereabove.

14. The apparatus defined in claim 7 wherein said electrode means comprises a first and second electrode each received in said cover and reaching therefrom toward the surface of the liquid slag but terminating thereabove and a third electrode received in said cover and in contact with the liquid slag therein.

* * * * *